US011432984B2

(12) United States Patent
Hanlan et al.

(10) Patent No.: US 11,432,984 B2
(45) Date of Patent: Sep. 6, 2022

(54) DENTAL TOOL HOLDER

(71) Applicants: Kristen Hanlan, Bridgeport, WV (US); Samantha Henke, Vienna, WV (US)

(72) Inventors: Kristen Hanlan, Bridgeport, WV (US); Samantha Henke, Vienna, WV (US)

( * ) Notice: Subject to any disclaimer, the term of this patent is extended or adjusted under 35 U.S.C. 154(b) by 536 days.

(21) Appl. No.: 16/376,322

(22) Filed: Apr. 5, 2019

(65) Prior Publication Data

US 2019/0307629 A1 Oct. 10, 2019

Related U.S. Application Data

(60) Provisional application No. 62/653,430, filed on Apr. 5, 2018.

(51) Int. Cl.
*A61G 15/16* (2006.01)

(52) U.S. Cl.
CPC ..... *A61G 15/16* (2013.01)

(58) Field of Classification Search
CPC ..... A61G 15/16; A61G 15/14; A61C 19/02; A61C 3/04; A61C 1/10; A61C 1/14–148; A61C 1/16; A61C 1/12; A61C 19/00; A61B 50/20; A61B 50/24; A61B 50/26; A61B 2050/21; Y10S 211/00; Y10S 211/01; H01F 7/0252; B25H 3/00; B25H 3/04; B25H 3/06
USPC ..... 433/77, 79, 108; 312/231
See application file for complete search history.

(56) References Cited

U.S. PATENT DOCUMENTS 2,939,671 A * 6/1960 Beekman ..... F16L 3/00 248/683
3,229,820 A 1/1966 Hentzi
3,774,773 A * 11/1973 Brent ..... A61G 15/16 211/70.6
3,776,387 A * 12/1973 Brent ..... A61B 50/24 211/70.6
4,944,410 A 7/1990 Goet
4,997,412 A * 3/1991 Reed ..... B62D 11/18 475/24
5,301,822 A 4/1994 Coleman et al.
5,997,297 A * 12/1999 Coburn ..... A61G 15/16 433/77
7,510,092 B2 3/2009 Sholem
9,210,996 B1 * 12/2015 Kramer ..... A46B 17/02
9,630,286 B1 4/2017 Pomerenke
2003/0196922 A1 * 10/2003 Reaux ..... A61B 17/06161 206/370
2019/0021455 A1 * 1/2019 Valenti ..... A44C 5/0053

FOREIGN PATENT DOCUMENTS

EP 0820732 A2 * 1/1998 ..... A61G 15/16
GB 2043437 A * 10/1980 ..... A61G 15/125

* cited by examiner

*Primary Examiner* — Jacqueline T Johanas
*Assistant Examiner* — Shannel Nicole Belk
(74) *Attorney, Agent, or Firm* — Dunlap Bennett & Ludwig, PLLC

(57) ABSTRACT

A dental tool holder includes a body having a front wall. The front wall includes a magnetic material. The dental tool holder further includes a coupler. The coupler releasably secures the body to a dental stand or a dental chair. When in use, a dentist, dental hygienist, or a dental assistant may dock the dental tools onto the dental tool holder by placing the dental tool within a magnetic proximity of the front wall. The magnetic attraction between the front wall and the dental tool releasably retains the dental tool to the dental tool holder.

13 Claims, 4 Drawing Sheets

DENTAL TOOL HOLDER

CROSS-REFERENCE TO RELATED APPLICATION

This application claims the benefit of priority of U.S. provisional application No. 62/653,430, filed Apr. 5, 2018, the contents of which are herein incorporated by reference.

BACKGROUND OF THE INVENTION

The present invention relates to dental tools and, more particularly, to a magnetic dental tool holder.

Traditional dental equipment is designed to house the operator's instrumentation, such as a saliva ejector, a high-speed evacuator, and an air/water syringe, in a plastic docking station within reach of the dental operator. Currently, an operator's instrumentation station is made of plastic and is designed to house the tools in individual docking stations suspended above the floor. In operation, the operator must accurately dock the tools into the existing station while concentrating upon the dental patient.

The current system design is not conducive to the fast pace and independent working conditions of the dental operator. Dental tools are easily and accidentally dropped to the floor rather than being docked successfully. If dropped, operators must cease work on the patient and replace and disinfect all contaminated equipment. The disinfecting process is time consuming and frustrating to both the operator and the patient.

As can be seen, there is a need for a dental tool holder that quickly and easily secures dental tools.

SUMMARY OF THE INVENTION

In one aspect of the present invention, a dental tool holder comprises: a body comprising a front wall, the front wall comprising a magnetic material configured to releasably retain at least one dental tool by a magnetic attraction; and a coupler configured to releasably secure the body to at least one of a dental stand and a dental chair.

In another aspect of the present invention, a method of docking at least one dental tool comprises: providing a dental tool holder comprising a body comprising a front wall, the front wall comprising a magnetic material; and releasably attaching a dental tool to the front wall of the body by placing the dental tool within a magnetic proximity of the front wall, wherein the dental tool comprises at least one of a magnetic material and a ferrous material that is magnetically attracted to the magnetic material of the front wall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an innovative magnetic dental tool mounting device which mitigates the need for accuracy when returning the equipment to its station and reduces the need for multiple attempts to dock the tools. By magnetizing the docking station, the dental tools, or both, dental professionals are able to return these critical tools to the docking station without the need for precision. The present invention reduces the frequency of dropped tools and improves the effectiveness of the operator and the experience of the patient.

The innovated new system of the present invention can be incorporated in every dental office. The present invention can be incorporated into newly manufactured systems and retrofitted onto existing dental equipment.

Figure 1:
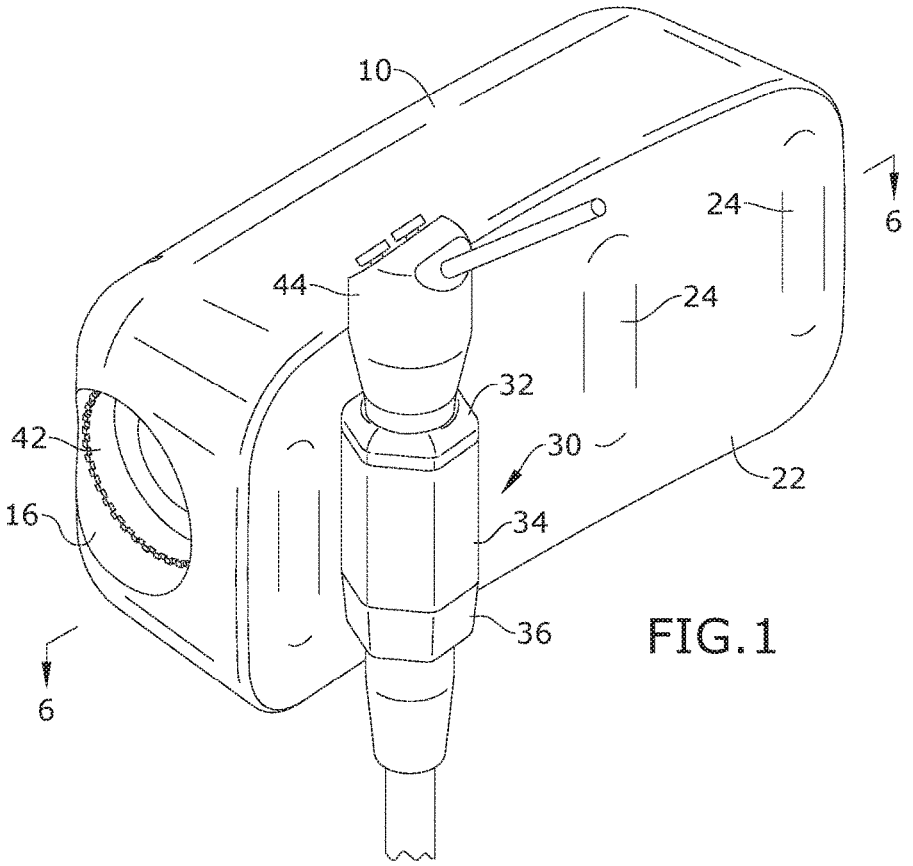
FIG. 1 is a front perspective view of an embodiment of the present invention.
Figure 2:
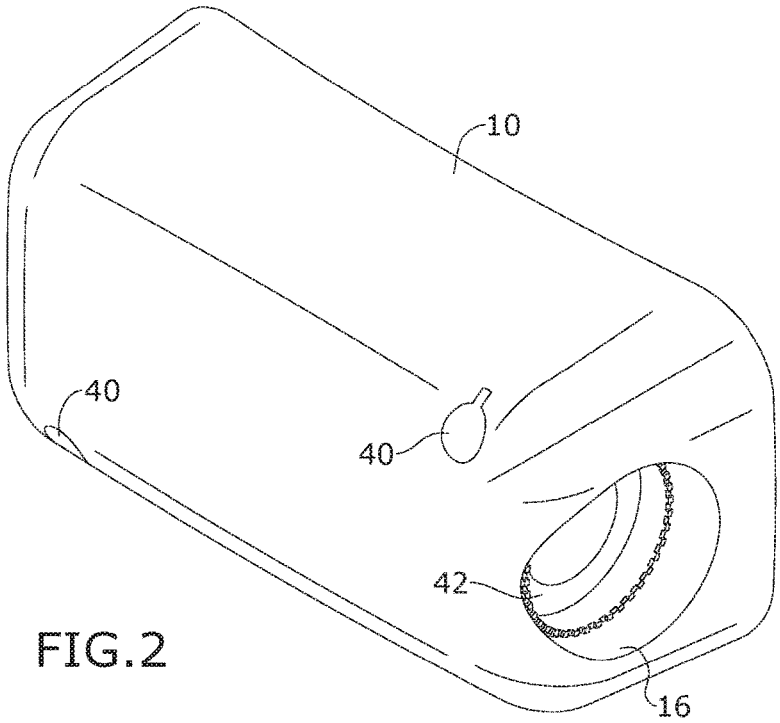
FIG. 2 is a rear perspective view of an embodiment of the present invention.
Figure 3:
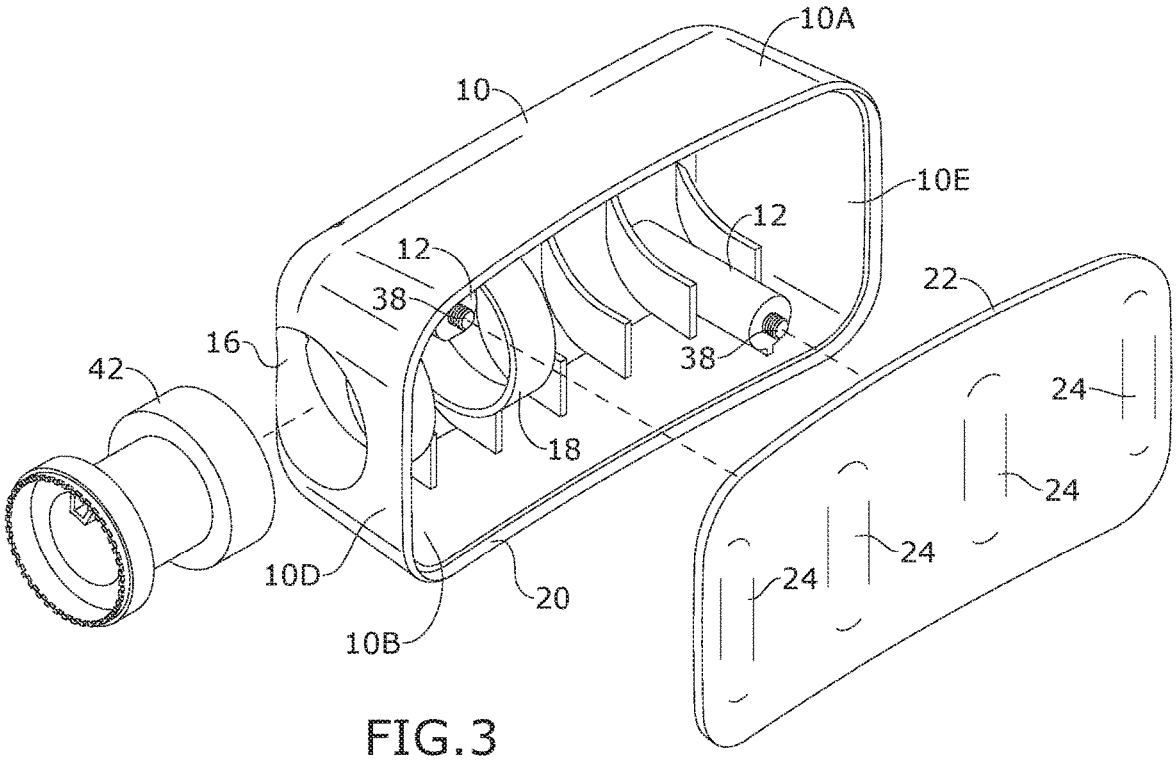
FIG. 3 is a front exploded view of an embodiment of the present invention.
Figure 4:
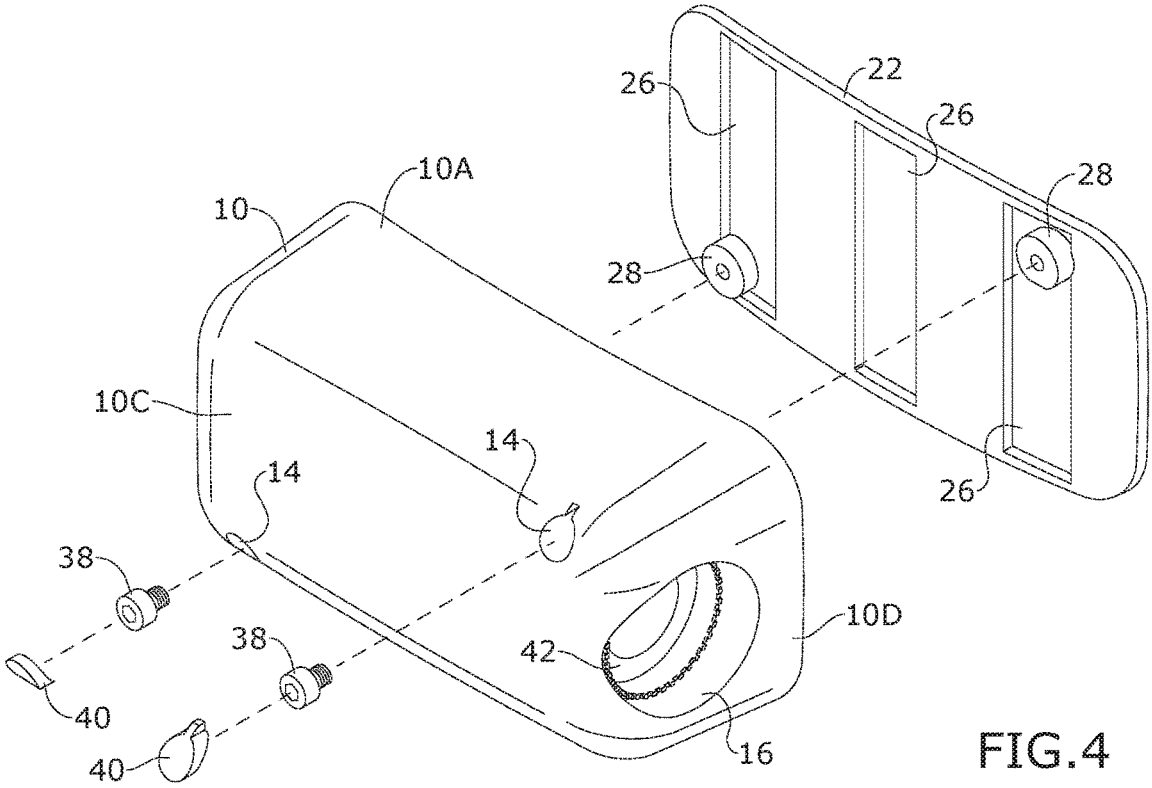
FIG. 4 is a rear exploded view of an embodiment of the present invention.
Figure 5:
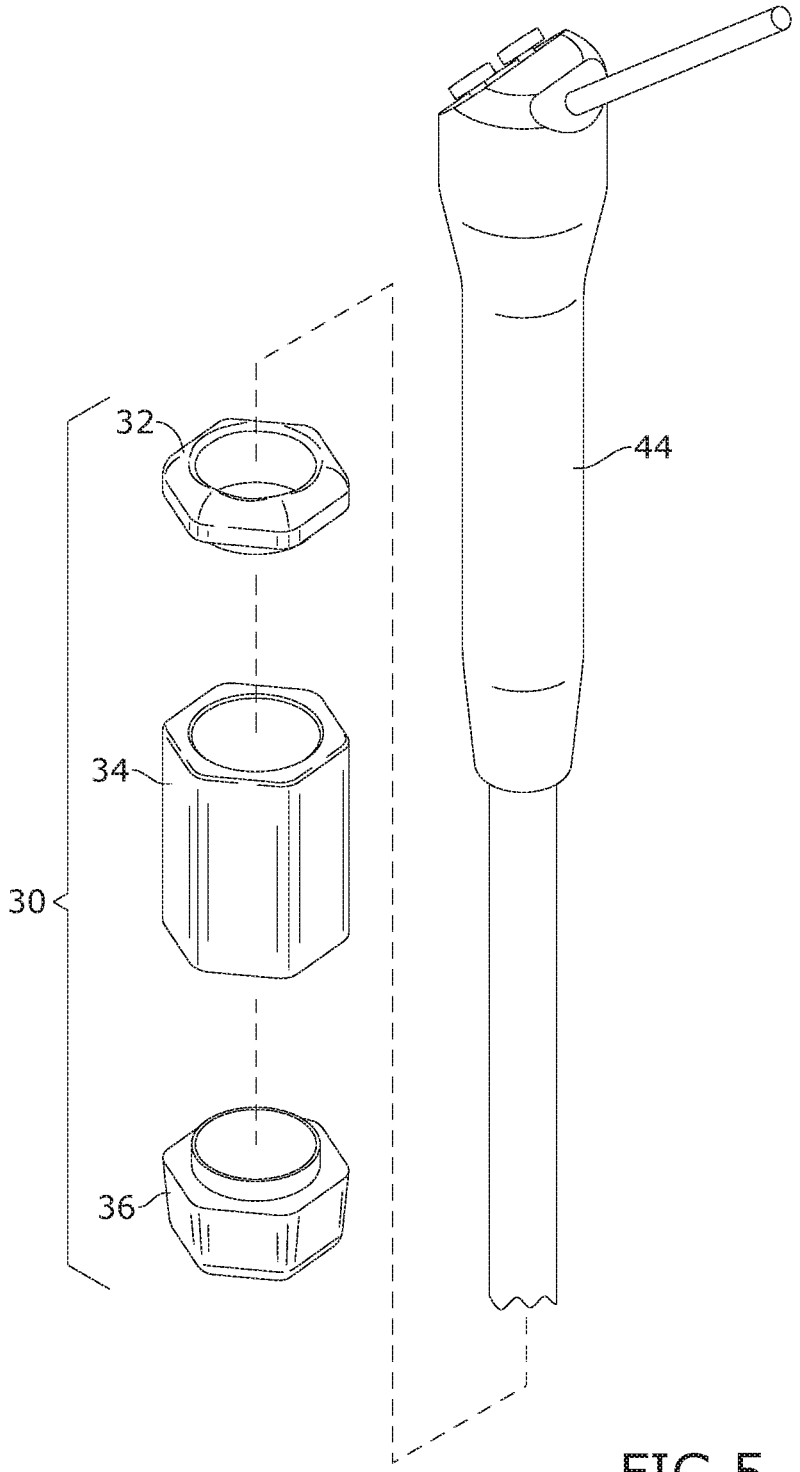
FIG. 5 is an exploded view of a sleeve assembly of an embodiment of the present invention.
Figure 6:
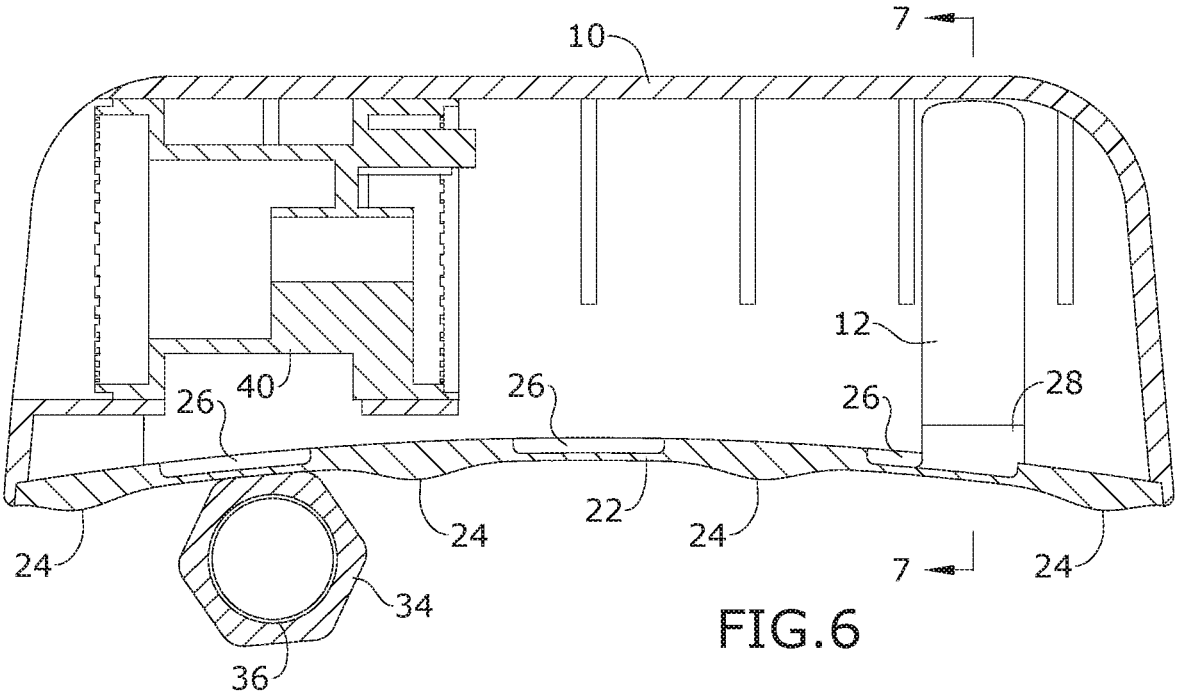
FIG. 6 is a section view of the present invention taken along line 6-6 in FIG. 1.
Figure 7:
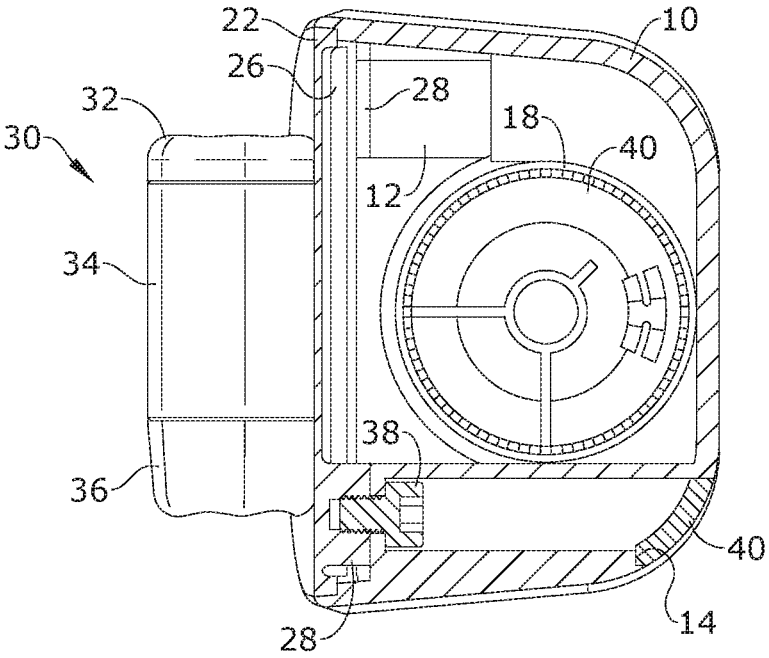
FIG. 7 is a section view of the present invention taken along line 7-7 in FIG. 6.

Referring to FIGS. 1 through 7, the present invention includes a dental tool holder. The dental tool holder includes a body 10 having a front wall 22. The front wall 22 includes a magnetic material. The magnetic material may be a ferrous metal or a magnet. The dental tool holder further includes a coupler 42. The coupler 42 releasably secures the body 10 to a dental stand or a dental chair. When in use, a dentist, dental hygienist, or a dental assistant may dock the dental tools 44 onto the dental tool holder by placing the dental tool 44 against the front wall 22 or within a magnetic proximity of the front wall 22. The magnetic attraction between the front wall 22 and the dental tool 44 releasably retains the dental tool 44 to the dental tool holder.

The body 10 of the present invention may include a hollow housing having a top wall 10*a*, a bottom wall 10*b*, a rear wall 10*c*, the front wall 22, a first side 10*d*, and a second side 10*e*. In certain embodiments, the body 10 may include an elongated rectangular cuboid shape. The front wall 22 may include the elongated shape in which multiple dental tools 30 may be attached.

The body 10 may be constructed out of any materials known within the art with sufficient strength, durability and utility for the specific application, including but not limited to, aluminum, steel, plastic, composite, fiberglass, nylon, and all other suitable materials or combinations of materials. The body 10 may also be constructed from materials which increase the comfort of the user, protect the supported dental tools 44, or protect or decorate the present invention. The body 10 may also be wrapped, coated, or padded with other materials to achieve user comfort, device protection, and/or decoration.

The coupler 42 of the present invention may include an attachment component configured to releasably secure the body 10 to a dentist chair or stand. For example, the coupler 42 may be a clip, tie, clamp, buckle, snap on device, hook and loop material, magnets, and the like. Presently, dental chairs are equipped with a protruding rod secured to a rod coupler. In certain embodiments, the coupler 42 may directly secure to the rod coupler of an existing dental chair. In such embodiments, a coupler hole 16 may be defined on the first side 10*d* of the body 10. A holder ring 18 may be disposed on the inside of the body 10 and may align with the coupler hole 16. The coupler 42 may include a tube-shaped body having a circular outer edge having a plurality of teeth. The tube-shaped body fits within the coupler hole 16 and the holder ring 18. The protruding rod may be removed from the rod coupler of the dental chair. A user may place the rod coupler of the dental chair into the coupler hole 16 so that the plurality of teeth interlock the rod coupler and attach the body 10 to the dental chair.

As mentioned above, the front wall 22 may be elongated and sized to retain multiple dental tools 30. The front wall 22 may further include a concave shape running from the first end 10*d* to the second end 10*e*. Additionally, a front surface of the front wall 22 may include a plurality of ridges 24 defining recesses therebetween. The concave shape and the recesses allow for users to easily place the dental tools 44 on the front wall 22 and separate the dental tools 44 by placing the dental tools 44 within the recesses. The rear surface of the front wall 22 may include a plurality of cavities 26.

In certain embodiments, the front wall 22 is releasably retained to the body 10. In such embodiments, the body 10 may include a front wall slot 20. The front wall 22 fits within the front wall slot 20 and attaches to the body 10. The inner surface of the front wall 22 may include a plurality of threaded screw receiver posts 28 that align with screw receivers 12 running from the rear wall. Screws 38 fit within openings 14 of the rear wall, into the screw receivers 12 and mechanically fasten to the plurality of threaded screw receiver posts 28, releasably retaining the front wall 22 to the body 10. Caps 40 may fit within the openings 14 to hide the screws 38.

The dental tools 44 may be made with a ferrous material or may include a magnet to releasably attach to the front wall 22. For dental tools 44 that are not made of a ferrous or magnetic material, the present invention may utilize a collar 30. The collar 30 may releasably attach to the dental tool 44. The collar 30 includes at least one of a magnetic material and a ferrous material magnetically attracted to the front wall 22. In certain embodiments, the collar 30 includes a sleeve 34 that fits around a handle of the dental tool 44. A top retaining ring 32 and a bottom retaining ring 36 releasably couple the sleeve 34 to the handle of the dental tool 44.

The present invention may further include a method of docking dental tools 44. The method includes providing the dental tool holder described above. Couple the dental tool holder to a dental stand or a dental chair. In certain embodiments, the dental tool holder is coupled to the dental chair by removing the rod from the rod coupler and placing the rod coupler of the dental chair into the coupler hole 16 of the body 10 so that the plurality of teeth interlock with a rod coupler and attach the body 10 to the dental chair. Alternatively, the dental tool holder may include its own stand. Releasably attach a dental tool 44 to the front wall 22 of the body 10 by placing the dental tool 44 within a magnetic proximity of the front wall 22. The magnet or ferrous material of the dental tool 44 magnetically attracts to the magnetic material of the front wall 22, releasably retaining the dental tool 44 to the dental tool holder. A plurality of dental tools 44 may be placed within the recesses of the front wall 22. In operation, the user simply grabs the dental tool 44 and pulls it away from the front wall 22 and when finished using the tool 44 the user merely places the dental tool 44 in proximity to the front wall 22 such that the magnetic attraction of the tool 44 attaches the dental tool 44 to the front wall 22 for storage until needed again.

In some embodiments, the device may be utilized in the dental, medical, cosmetic, manufacturing, or art industries.

It should be understood, of course, that the foregoing relates to exemplary embodiments of the invention and that modifications may be made without departing from the spirit and scope of the invention as set forth in the following claims.

What is claimed is:

1. A dental tool holder comprising:

a body comprising a front wall, a bottom wall, a first side, a second side, and a top wall;

the front wall comprising a magnetic material configured to releasably retain at least one dental tool by a magnetic attraction;

a coupler configured to releasably secure the body to at least one of a dental stand and a dental chair; and a collar magnetically attracted to the front wall, wherein the collar comprises a sleeve having a continuous outer periphery of a plurality of facets, and wherein an inner periphery of the sleeve is configured to removably couple to a handle of the at least one dental tool, wherein the coupler is disposed at the first side and comprises a tube-shaped body having a circular outer edge comprising a plurality of teeth configured to interlock with a rod coupler of the dental chair, wherein a front surface of the front wall comprises a concave curve running from the first side to the second side, wherein a front surface of the front wall comprises a plurality of ridges defining recesses therebetween, and wherein each facet of the plurality of facets is dimensioned to be disposed between two adjacent ridges of the plurality of ridges.

2. The dental tool holder of claim 1, wherein the front wall is releasably retained to the body.

3. The dental tool holder of claim 2, wherein an inner surface of the front wall comprises a plurality of threaded screw receiver posts that align with screw receivers running from a rear wall of the body, wherein screws fit within the screw receivers and mechanically fasten to the plurality of threaded screw receiver posts, releasably retaining the front wall to the body.

4. The dental tool holder of claim 1, wherein the sleeve comprises top and bottom retaining rings configured to releasably couple the sleeve to the handle, wherein said retaining rings each have a continuous outer periphery of ring facets that complement said plurality of facets.

5. A method of docking at least one dental tool comprising:

providing a dental tool holder comprising a body comprising a front wall, the front wall comprising a magnetic material;

providing a collar magnetically attracted to the front wall, wherein the collar comprises a sleeve having a continuous outer periphery of a plurality of facets;

removably coupling an inner periphery of the sleeve to a handle of a dental tool; and releasably attaching a dental tool to the front wall of the body by placing the sleeve within a magnetic proximity of the front wall, wherein the sleeve comprises at least one of a magnetic material and a ferrous material that is magnetically attracted to the magnetic material of the front wall, wherein a front surface of the front wall comprises a plurality of alternating ridges and recesses, and wherein each facet of the plurality of facets is dimensioned to be disposed between two adjacent ridges of the plurality of alternating ridges.

6. The method of claim 5, further comprising coupling the dental tool holder to at least one of a dental stand and a dental chair.

7. The method of claim 5, wherein the body further comprises a coupler disposed at a first side, wherein the coupler comprises a tube-shaped body having a circular outer edge comprising a plurality of teeth.

8. The method of claim 7, further comprising:

releasably attaching the coupler to a dental chair by interlocking the plurality of teeth with a rod coupler of the dental chair.

9. The method of claim 5, wherein the front wall is releasably retained to the body.

10. The method of claim 5, wherein the body comprising a rear wall, wherein an inner surface of the front wall comprises a plurality of threaded screw receiver posts that align with screw receivers running from the rear wall, wherein screws fit within the screw receivers and mechanically fasten to the plurality of threaded screw receiver posts, releasably retaining the front wall to the body.

11. The method of claim 5, wherein a front surface of the front wall comprises a concave curve.

12. The method of claim 5, wherein the dental tool is releasably attached within the recesses of the front surface.

13. The method of claim 5, wherein the sleeve comprises top and bottom retaining rings configured to releasably couple the sleeve to the handle, wherein said retaining rings each have a continuous outer periphery of ring facets that complement said plurality of facets.

* * * * *